United States Patent [19]

Gorodissky et al.

[11] 4,186,571

[45] Feb. 5, 1980

[54] DEVICE FOR LUBRICATION OF ROLLER SEAL

[75] Inventors: Leonid G. Gorodissky; Raisa V. Vasilieva; Vyacheslav I. Zhmurov; Mikhail D. Kozlov; Vera I. Kuzmina, all of Moscow, U.S.S.R.; Nikolai T. Romanov, deceased, late of Moscow, U.S.S.R.; by Anastasia I. Romanova, administratrix

[73] Assignee: Vsesojuzny Nauchno-Issledovatelsky I Experimentalny Institut Po Pererabotke Khimicheskikh Volokon, U.S.S.R.

[21] Appl. No.: 864,437

[22] Filed: Dec. 27, 1977

[51] Int. Cl.[2] ..... D06B 23/18

[52] U.S. Cl. ..... 68/5 E; 34/242

[58] Field of Search ..... 68/5 E, 202; 34/242; 277/15, 135; 118/227

[56] References Cited

U.S. PATENT DOCUMENTS

| | | | |
|---|---|---|---|
| 3,255,616 | 6/1966 | Rust, Jr. | 68/5 E |
| 3,367,151 | 2/1968 | Fujihashi | 68/5 E |
| 4,102,158 | 7/1978 | Sando et al. | 68/5 E |

FOREIGN PATENT DOCUMENTS

| | | | |
|---|---|---|---|
| 1460535 | 3/1969 | Fed. Rep. of Germany | 68/5 E |

*Primary Examiner*—Philip R. Coe

*Attorney, Agent, or Firm*—Steinberg and Blake

[57] ABSTRACT

The device comprises a circular container for collecting the dripping down lubricant. Said container is located between the tiers of baffle plates and is connected by a recirculating pipe line with the roller lubricating pipe line. The device incorporates a tubular air heater which heats the surfaces of the baffle plates that might get in contact with the fabric being processed, and a heat exchanger in the lubricant supply line.

4 Claims, 2 Drawing Figures

DEVICE FOR LUBRICATION OF ROLLER SEAL

BACKGROUND OF THE INVENTION

The present invention relates to sealing devices and more particularly, to the seals of a chamber for treating a strip-like material under overpressure.

The present invention will be used to the best of advantage in the textile dyeing and finishing production, particularly in the chambers wherein the fabric is treated at elevated temperatures in steam or water media.

DESCRIPTION OF THE PRIOR ART

Known in the prior art are seals of the chambers for treating a strip-like material under overpressure (see, for example, U.S. Pat. No. 3,320,776, Cl. 68-5) which are capable of functioning only being filled with water. There are other known seals (see U.S. Pat. Nos. 3,367,151 and 3,255,616, Cl. 68-5) wherein the lubricant does not fill the entire casing but still there is a risk of the processed fabric being splashed with lubricant.

Besides, the lubricant here cannot be collected and returned into the working zone which results in excessive consumption of the lubricating material. And there are no appliances for cooling or heating the lubricant which might be necessary for some kinds of lubricant.

When solving the problem of providing a reliable seal for continuous treatment of fabric under pressure, many known technical solutions include a seal incorporating such friction pairs as stainless steel and heat-resistant synthetic rubber. It is common knowledge that such a friction pair operates within an extremely wide range of loads and velocities but calls for liberal lubrication and reliable cooling. The lubricating and cooling agent can be machine oil, oil-water emulsion or condensate of water steam, the latter being most preferable because its temperature cannot rise above the temperature of saturated steam used for treating the fabric. However, irrespective of the kind of lubricant, especially when the end and cylindrical surfaces of the rollers are liberally and efficiently lubricated, said lubricant is liable to be splashed on the fabric being processed which always leads to wastage of the latter. In addition, when lubrication is carried out with water steam condensate at temperatures approaching the temperature of processing, the protruding surfaces of the lubricant discharge appliance become covered with condensate which, due to vibrations of the processed fabric, also gets on its surface and brings about its wastage.

In the circumstances requiring liberal lubrication the use of an open-circuit lubricating system becomes extremely impracticable from the viewpoint of economy of seal operation because it involves a large consumption of lubricating fluid. The use of a recirculating system leads inevitably to the introduction of heat-exchanging devices for cooling some types of lubricant and heating the other ones.

OBJECTS OF THE INVENTION

An object of the present invention is to provide a device for lubrication of a roller seal which would permit continuous treatment of fabric under pressure and prevent the droplets of lubricant from getting on said fabric.

Another object of the invention is to provide a device for lubrication of a roller seal which would prevent accumulation of undue moisture on the surfaces of parts (baffle plates) which might get in contact with the fabric being treated.

One more object of the present invention is to provide a device for lubrication of a roller seal which would give a saving in the lubricating fluid.

And still another object of the present invention is to provide such a device which would ensure long life of the roller seal and a high quality of the treated fabric.

SUMMARY OF THE INVENTION

These and other objects are accomplished according to the present invention by providing a device for lubrication of a roller seal consisting of parallel rollers rotating in contact with one another and passing between them the treated fabric in a vertical plane, and comprising a roller lubricating appliance, a lubricant discharge appliance, a heating unit and a group of baffle plates arranged in two tiers, one upon the other in the lubricant drip-down zone; this device is characterized in that the lubricant discharge appliance is made in the form of a circular container located under the rollers between said two tiers of the baffle plates which collect the dripping lubricant into said containers while said heating unit is constituted by a tubular air heater which is in thermal contact with said circular container communicating with the pipe line of the roller lubricating appliance.

Such a technical solution permits all of the lubricant which drips downwardly to be collected without waste and the treated fabric to be protected against the splashes of the lubricating agent irrespective of the intensity of its movement. In addition, such a technical solution permits the use of a well-cooled lubricating agent and makes it possible to avoid over-moistening of the fabric delivered into the overpressure zone by heating the latter.

According to the embodiment of the present invention disclosure is made of a device for lubrication of a roller seal characterized in that said circular container of the lubricant discharge appliance is connected by a recirculating pipe incorporating a pump with the pipe line of the roller lubricating appliance.

Such a technical solution permits economical use of the lubricant which can be returned into the friction zone and gives a reduction not only in the lubricant consumption but also in the thermal energy because the temperature of lubricant must be constant and, if additional quantities of it are introduced, they have to be heated. Therefore, the greater the lubricant leaks, the higher the energy consumption.

According to another embodiment of the present invention, disclosure is made of a device for lubrication of a roller seal characterized in that if the rollers are lubricated with machine oil, said device is provided with a heating heat exchanger located at the end of the pipe line of the roller lubricating appliance in the zone after the point where said recirculating lubricant is supplied into said pipe line.

Such a technical solution permits not only maintaining the lubricant temperature at a preset level but also, if necessary, preventing accumulation of water steam condensate in the lubricating agent.

According to still another embodiment of the present invention, disclosure is made of a device for lubrication of a roller seal characterized in that, if the rollers are lubricated with condensate of water steam, said device incorporates a cooling heat exchanger installed in the recirculating pipe at the point of lubricant discharge from the circular container.

Such a technical solution ensures efficient use of lubricating agent in the form of water steam condensate which is accumulated inevitably in the vessels filled with saturated water steam under pressure. The condensate can be cooled to 10°-30° C. below the working temperature. Being cooled, the water steam condensate is an effective lubricating agent since it forms no scale when it boils out in the zone of friction. Besides, by cooling the circulation zone it becomes possible to prevent completely the boiling of condensate in the zone of friction.

DESCRIPTION OF THE DRAWINGS

Now the present invention will be described in detail by way of example with reference to the accompanying drawings, in which.

DESCRIPTION OF THE PREFERRED EMBODIMENT

Figure 1:
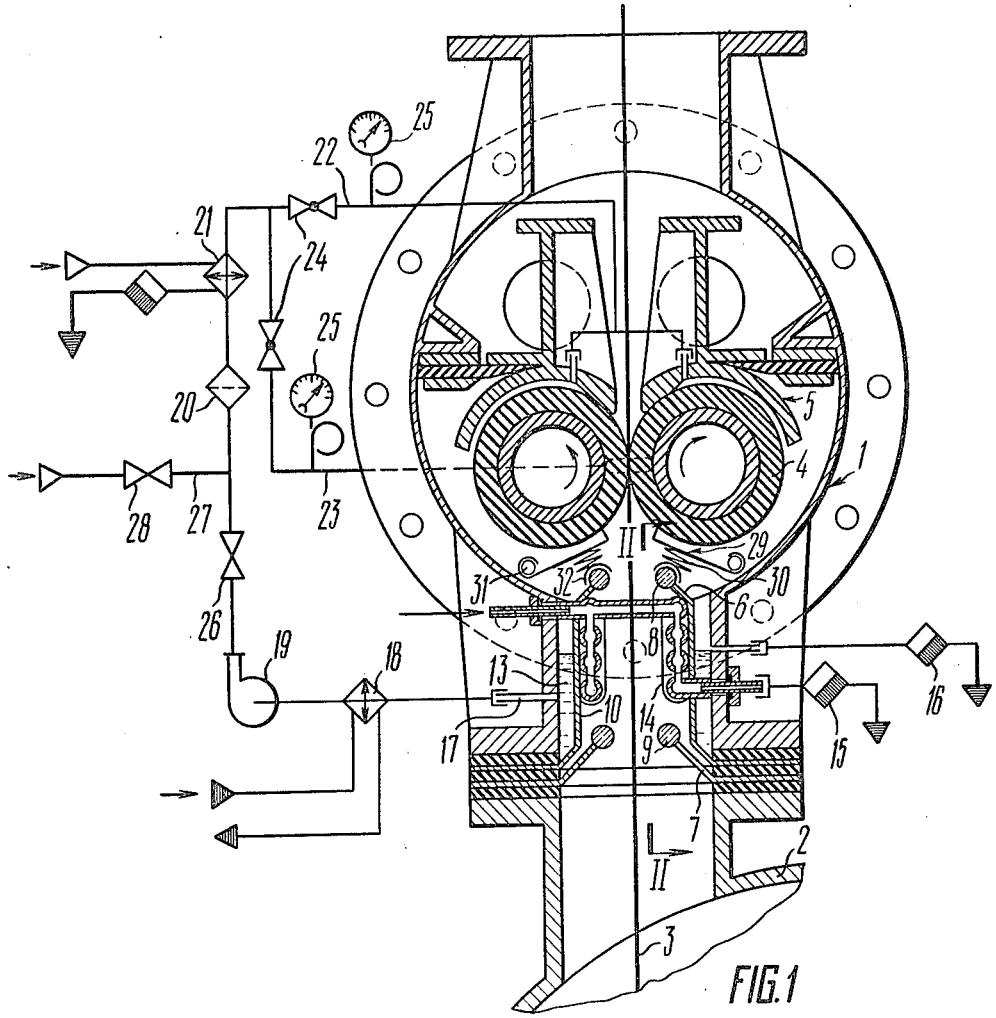
FIG. 1 is a schematic cross section of the seal in a chamber for treating a strip-like material under overpressure according to the invention.

The seal of the chamber for treating a strip-like material under overpressure comprises a hollow casing 1 (FIG. 1) mounted on a chamber 2 for treating fabric 3. The hollow casing 1 has the shape of a horizontally arranged cylinder.

The hollow casing 1 accommodates a pair of driving rollers 4 for conveying the fabric being treated, and a sealing device 5. This device 5 jointly with the rollers 4 maintains overpressure in the chamber 2 and carries the fabric 3 into, or out of, the chamber 2.

According to the invention, the seal casing 1 incorporates an upper pair of baffle plates 6 and lower pair of baffle plates 7 arranged on both sides of the fabric 3. Each pair of the baffle plates 6 and 7 has bars 8 and 9 fixed at the free ends. The baffle plates 6 are tightly connected with the side walls 10, 11 (FIG. 2) which form, together with the baffle plates 6, a circular channel constituting a container 12 filled with lubricant 13. Located between the baffle plates 6 and the fabric 3 are air heaters 14 which are heated with saturated steam supplied through a pressure regulator (not shown in the drawing). The air heaters 14 are provided with a condensate remover 15. The circular channel likewise has a condensate remover 16.

Arranged below the level of the lubricant 13 in container 12 is a recirculating pipe line 17 communicating through a cooling heat exchanger 18, pump 19, at least one filter 20, and heating heat exchanger 21 with the pipe line 22 delivering lubricant to the cylindrical surface of the rollers 4 and with the system 23 delivering lubricant to the end surfaces of the rollers 4. The lubricant supply systems 22 and 23 are provided, each, with a pressure regulating appliance, e.g. a cock 24 and a pressure gauge 25. Installed between the pump 19 and the filter 20 is a valve 26. A channel 27 with a valve 28 located between the valve 26 and the filter 20 serves for filling the system with lubricant.

The discharge seal wherein the rollers 4 rotate in the directions shown by arrows in FIG. 1 must be provided with scrapers 29 and plate springs 30 for removing the surplus lubricant which remains on the surface of rollers 4. The scrapers 29 are articulated on pins 31 secured in the seal casing 1. All the springs are fastened to each respective scraper 29 at one end and to an elongate holder 32 at the other, said holder resting on a respective one of the bars 8. The filter 20 must be made up of one or more filtering portions cut in parallel into the pipe line thus permitting one of the sections to be disconnected and cleaned without the drop of pressure in the line. The necessity for cleaning will become apparent by measuring the pressure drop on the filter with the aid of a differential pressure gauge or two ordinary pressure gauges (not shown in the drawings) which measure pressure before and after the filter. The reference pressure gauge should be of an electric contact type sending an emergency signal or a command pulse for stopping the rollers.

Figure 2:
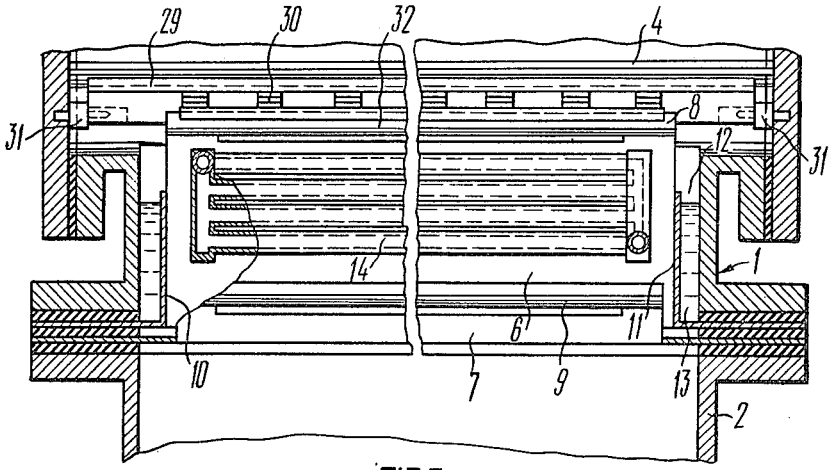
FIG. 2 is a section taken along line II—II in FIG. 1.

The device functions as follows. Any type of lubricant suitable for lubricating the friction pair, i.e., the friction rollers 4, is supplied through the open valve 28 until it starts flowing out of the condensate remover 16. The air heater 14 is heated with steam at such a pressure such that no drops of lubricant fall on the fabric. The steam condensate is removed through the condensate remover 15. Prior to turning on the drive of the rollers 4, the pump 19 is started and the supply of lubricant into the friction zones is adjusted by means of the cocks 24, the pressure in the corresponding channels being checked by the pressure gauges 25. To ensure reliable lubrication, the lubricant is always supplied into the zones of friction in surplus quantities. The surplus lubricant 13 from the friction zone drips down along the walls of the casing 1 while in the discharge seal it flows down along the casing walls and the scrapers 29. These scrapers 29 remove uniformly the surplus lubricant from the surface of the corresponding rollers 4 because each of them is uniformly pressed against the surface of the roller 4 by plate springs 30 as shown in FIGS. 1 and 2. In case of radial shifting of the rollers said springs 30 turn the scrapers 29 on the pins 31, ensuring reliable and constant contact between the cylindrical surfaces of the rollers 4 and scrapers 29. Thus, the fabric 3 is reliably protected against the splashes of lubricant by the scrapers 29 and baffle plates 6. The bars 8 and 9 keep the fabric out of contact with the heated air heater 14.

If the rollers are lubricated with a material which is not to be mixed with the water steam condensate, the fluid is heated by the heating heat exchanger 21. If, however, they are lubricated with water steam condensate or with water emulsions, the lubricating fluid must be cooled by the cooling heat exchanger 21 in which case the heating heat exchanger 18 is inoperative. When the device is lubricated with a material at a temperature which is lower than the fabric processing temperature, the external surfaces of the baffle plates become covered with accumulated condensate. This condensate is prevented from getting on the fabric by the baffle plates 7. The pure condensate accumulated after the baffle plates 7 is removed by any known method together with the condensate formed on the walls of the chamber 2.

We claim:

1. A device for lubrication of a roller seal including parallel rollers rotating in contact with one another and adapted to pass between them the treated fabric in a vertical plane; said device comprising a roller lubricating pipe line having a discharge end associated with said rollers for supplying a lubricant thereover, a group of baffle plates arranged in two tiers under the rollers in the fabric conveyance zone; a circular container defined outwardly of at least said upper tier of baffle plates for collecting a surplus of the lubricant supplied to said rollers; a tubular air heater which is in thermal contact with said circular container, and a recirculating pipe line fluidly interconnecting said circular container with the roller lubricating pipe line.

2. A device according to claim 1 further including a pump interposed in said recirculating pipe line.

3. A device for lubrication of a roller seal according to claim 2 wherein said device further includes a cooling heat exchanger interposed in the recirculating pipe line in the vicinity of the region at which lubricant discharges from the circular container into the recirculating pipe line.

4. A device according to claim 1 wherein said device further includes a heating heat exchanger interposed in said roller lubricating pipe line in a zone after a point at which said recirculating lubricant pipe line communicates with said roller lubricating pipe line.

* * * * *